US005252196A

United States Patent [19]

Sonnenberg et al.

[11] Patent Number: 5,252,196

[45] Date of Patent: Oct. 12, 1993

[54] COPPER ELECTROPLATING SOLUTIONS AND PROCESSES

[75] Inventors: Wade Sonnenberg, Hull; Gordon Fisher, Sudbury; Roger F. Bernards, Wellesley; Patrick Houle, Framingham, all of Mass.

[73] Assignee: Shipley Company Inc., Newton, Mass.

[21] Appl. No.: 803,281

[22] Filed: Dec. 5, 1991

[51] Int. Cl.[5] ..... C25D 3/38

[52] U.S. Cl. ..... 205/296; 205/125; 205/298; 106/1.26

[58] Field of Search ..... 205/125, 296, 297, 298, 205/920, 126; 106/1.26

[56] References Cited

U.S. PATENT DOCUMENTS

| | | | |
|---|---|---|---|
| 3,267,010 | 8/1966 | Creutz et al. | 205/298 |
| 3,328,273 | 6/1967 | Creutz et al. | 205/298 |
| 3,770,598 | 11/1973 | Cruetz | 205/296 |
| 3,784,454 | 1/1974 | Lyde | 205/295 |
| 3,798,138 | 3/1974 | Ostrow et al. | 205/298 |
| 4,336,114 | 6/1982 | Mayer et al. | 205/298 |
| 4,347,108 | 8/1982 | Willis | 205/298 |
| 4,975,159 | 12/1990 | Dahms | 205/125 |
| 5,004,525 | 4/1991 | Bernards et al. | 205/291 |
| 5,051,154 | 9/1991 | Bernards et al. | 205/125 |
| 5,068,013 | 11/1991 | Bernards et al. | 205/125 |

FOREIGN PATENT DOCUMENTS

| | | |
|---|---|---|
| 0068807 | 6/1982 | European Pat. Off. . |
| 0297306 | 6/1988 | European Pat. Off. . |

*Primary Examiner*—John Niebling
*Assistant Examiner*—Brian M. Bolam
*Attorney, Agent, or Firm*—Robert L. Goldberg; Peter F. Corless

[57] ABSTRACT

Compositions and processes for electrolytic plating. The compositions are characterized by critical amounts of one or more brightening and leveling agents. The compositions are particularly useful for plating through hole walls of printed circuit boards, including through holes having an aspect ratio equal or greater than about ten to one.

46 Claims, 4 Drawing Sheets

COPPER ELECTROPLATING SOLUTIONS AND PROCESSES

BACKGROUND OF THE INVENTION

1. Field of the Invention

The present invention relates to electrolytic plating solutions which have particular utility for uniformly depositing a metal coating on the walls of printed circuit board through holes and on the surfaces of such boards.

2. Background Art

Methods for electroplating articles with metal coatings generally involve passing a current between two electrodes in a plating solution where one of the electrodes is the article to be plated. A typical acid copper plating solution comprises dissolved copper (usually copper sulfate), an acid electrolyte such as sulfuric acid in an amount sufficient to impart conductivity to the bath, and proprietary additives to improve the uniformity of the plating and the quality of the metal deposit. Such additives include brighteners, levelers, surfactants, suppressants, etc.

Electrolytic copper plating solutions are used for many industrial applications. For example, they are used in the automotive industry to deposit base layers for subsequently applied decorative and corrosion protective coatings. They are also used in the electronics industry, particularly for the fabrication of printed circuit boards. For circuit fabrication, copper is electroplated over selected portions of the surface of a printed circuit board and onto the walls of through holes passing between the surfaces of the circuit board base material. The walls of a through hole are first metallized to provide conductivity between the board's circuit layers.

Early efforts to make circuit boards used electrolytic copper plating solutions developed for decorative plating. However, as printed circuit boards became more complex and as industry standards became more rigorous, solutions used for decorative plating were often found to be inadequate for circuit board fabrication.

To provide a high quality and uniform metal deposit, it has been recognized that the concentration of several of the ingredients of the electrolytic plating solution (including brighteners and leveling agents) should be kept within relatively close tolerances during the plating process. It should be appreciated that the use of brighteners and levelers in an electroplating bath can be crucial in achieving a uniform metal deposit on a substrate surface.

Prior methods for controlling the concentration of electroplating bath components such as brighteners and levelers have included regular additions of the particular components based upon empirical rules established by experience. Such an approach has some notable and obvious shortcomings, however, as depletion of the bath components is not always constant with time and bath use. Another prior art method is to plate articles or samples and visually evaluate the plating quality to determine if the bath is performing satisfactorily. More specifically, in standard Hull Cell and "Bone Pattern" tests, a specially shaped test specimen is plated and then evaluated to determine the quality of the deposit. This is a relatively time consuming test which typically gives only a rough approximation of the concentration of the bath constituents. Other methods for evaluating the quality of an electroplating bath have been reported in U.S. Pat. No. 4,132,605, and Tench and White, *J. Electrochem. Soc.*, "Electrochemical Science and Technology", 831–834 (April 1985), both incorporated herein by reference.

In pending and commonly assigned U.S. patent application, Ser. No. 07/666,798, filed Mar. 8, 1991 (incorporated herein by reference and sometimes referred to herein as "said pending application"), a novel method is disclosed for determining the quantity of brighteners and levelers present in an electroplating bath. The method of said pending application monitors changes in energy output of the system over time for specific steps in the plating process. The method is based on differences in adsorption behavior of brighteners and levelers on metals. This differential adsorption behavior allows for controlled adsorption of first the brightener and then the leveler in two distinct steps. During the equilibration step, when no current flows, the organic brightener compounds are much more readily adsorbed on a metal electrode compared to the leveler compounds. The adsorption step is carried out for a time necessary to determine the concentration of the brightener. An optional electroplating pulse step can be used before or after equilibration to increase sensitivity or to shorten equilibration time. After the equilibration step, metal is plated, first to measure brightener concentration, and then the rate of change of energy output from the system is recorded in order to determine leveler concentration. The initial potential recorded during this step is a measure of the brightener concentration. When the energy output is plotted versus time, the slope of the line indicates the ratio of brightener to leveler present in the bath. The sensitivity of this process allows for determination of organic additive concentrations down to 1 ppb. As used herein, the term "ppb" refers to parts per billion, and the term "ppm" refers to parts per million.

Plating a substrate having irregular topography can pose particular difficulties. During electroplating a voltage drop variation typically will exist along an irregular surface which can result in an uneven metal deposit. Plating irregularities are exacerbated where the voltage drop variation is relatively extreme, i.e., where the surface irregularity is substantial. Consequently, high quality metal plating (e.g., a bright metal plate of substantially uniform thickness) is frequently a challenging step in the manufacture of printed circuit boards. Printed circuit boards often have "through holes", perforations through the board surface to provide attachment means for the board hardware and, in the case of both double-sided and multilayer boards, to provide interconnection between the board's circuit layers. For multilayer or double-sided boards, through hole walls are first metallized with copper before electroplating to provide conductivity between the two surfaces of the board and multiple circuit innerlayers of the board when they are present. Processes for the formation of conductive through holes are well known and described in numerous publications such as U.S. Pat. No. 4,515,829.

As may be evident from the foregoing, electrodepositing a uniform metal plate becomes more difficult in direct proportion to circuit board through hole geometry, i.e., the circuit board difficulty. Circuit board difficulty is defined to mean herein the thickness of the board multiplied by the ratio of the length of the board's through holes to the hole's diameter (known as the aspect ratio). As board difficulty increases, the voltage drop also increases between the plane surface of the board and the midpoint of a through hole. This voltage drop can result in plating irregularities including "dog boning", i.e., metal plates of uneven thickness on the through hole walls with the metal deposit thicker at the top and bottom of the holes and thinner at the center. The thin deposit at the hole midpoint can result in circuit defects and board rejection. Notwithstanding such problems associated with plating high difficulty circuit boards, the circuit board industry continuously seeks greater circuit densification and, hence, multilayer printed circuit boards of increased thickness (i.e., increased circuit layers) and difficulty.

Consequently, electroplating solutions that can provide good "throwing power" over irregular topography are highly desirable. In the case of a printed circuit board, throwing power of a plating solution has been defined as the ratio of current flowing at the center of a through hole of the circuit board to the current flowing at the board surface during use of the plating solution. See U.S. Pat. No. 5,051,154, incorporated herein by reference. Another measure of the throwing power of a plating solution is the ratio of the thickness of metal deposited in the mid-barrel of a through hole by the solution to the thickness of the metal plated at the circuit board plane surface, e.g., on the through hole's surface pad. An increase in a plating solution's throwing power can obviate "dog boning" and other plating irregularities along a through hole wall.

It thus would be desirable to have a copper electroplating solution that was useful for plating substrates having irregular topography. It would be particularly desirable to have a copper electroplating solution that could plate uniform copper deposits on through hole walls of high difficulty circuit boards.

SUMMARY OF THE INVENTION

The present invention comprises electrolytic plating solutions and processes for metal plating, including processes for plating the walls and through hole interconnections of printed circuit boards. The invention is based on a number of discoveries. A first discovery is of certain active species of brightening agents and use of the same in a plating solution. A further discovery is that brightening agents of an electrolytic copper plating solution are preferably employed in relatively low concentrations. It has been found that by employing the brightener agent concentrations disclosed herein, uniform copper plates can be deposited on a variety of surfaces including through hole walls of high difficulty multilayer circuit boards, for example through holes of an aspect ratio of ten or greater and a length of about 0.100 inches or greater. A further discovery of the invention is that copper deposits of enhanced quality are provided by employing an electrolytic plating solution having certain critical leveling agent concentrations. A yet further discovery is the use of certain concentration ratios of leveling and brightening agents of an electroplating solution to produce copper deposits of enhanced quality.

The electroplating solutions of the invention in general comprise at least one soluble copper salt, an electrolyte and an effective amount of a brightening agent. The plating solution may comprise additional organic additives, preferably one or more leveling agents and wetting (carrier) agents. Suitable electrolytes include a base such as potassium hydroxide, or a combination of an acid and halide ions, for example a combination of sulfuric acid and chloride ions.

In addition to copper electroplating solutions, the invention also provides processes for plating metal, including processes for plating substrates having irregular topography and processes for plating openings, e.g., printed circuit board through holes. In a preferred aspect, a process is provided for plating circuit board through holes having an aspect ratio of equal to or greater than about ten to one.

DETAILED DESCRIPTION OF THE INVENTION

Figure 1:
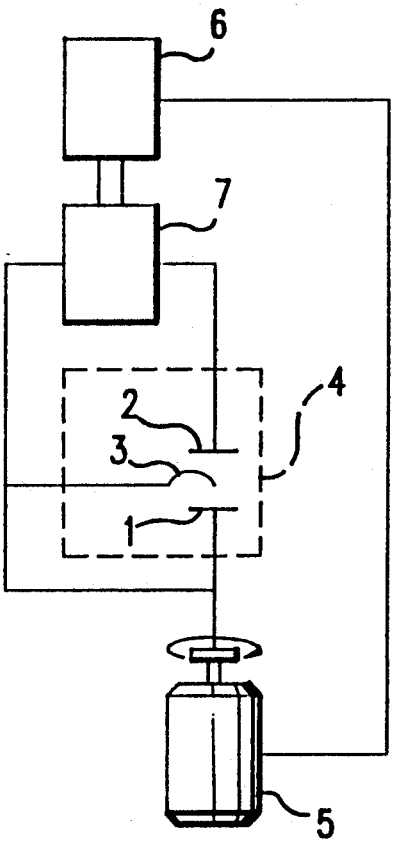
FIG. 1 is a schematic diagram of a device useful for determining concentrations of organic additives of an aqueous solution.

The plating solutions of the invention are useful for plating copper over a variety of surfaces and for variety of commercial uses. However, the solutions are especially useful for the manufacture of double sided and multilayer printed circuit boards requiring metallized through holes. Accordingly, the following description of the invention is generally directed to printed circuit fabrication using the solutions and processes of the invention.

In the fabrication of printed circuits, the starting material is typically a copper clad plastic, e.g., a copper clad glass fiber reinforced epoxy panel. Using subtractive techniques for the fabrication of the board for purposes of illustration, prior to formation of a circuit, conductive through holes are formed in the board by drilling and metallization. Processes for formation of conductive through holes are well known in the art and described in numerous publications including U.S. Pat. No. 4,515,829, incorporated herein by reference. Electroless plating procedures are used to form a first metallic coating over the through hole wall and electrolytic copper deposition is then used to enhance the thickness of the deposit. Alternatively, electrolytic copper may be plated directly over a suitably prepared through hole wall as disclosed in any of U.S. Pat. Nos. 4,810,333; 4,895,739; 4,952,286 and 5,007,990, all incorporated herein by reference.

The next step in the process comprises electroplating copper onto the thus prepared conductive through hole walls using an electroplating solution of the invention. A preferred electrolytic plating solution in accordance with the invention has the inorganic chemical composition set forth in Table 1 below.

TABLE 1

| Component | Amount |
|---|---|
| copper sulfate pentahydrate | 25 to 100 gm/liter |
| sulfuric acid | 100 to 300 gm/liter |
| chloride ions | 20 to 100 mg/liter |
| water | to 1 liter |

A variety of copper salts are suitably employed in the electroplating baths of the invention and include, for example, copper sulfate, copper acetate, copper fluoroborate, cupric nitrate. Copper sulfate pentahydrate is generally preferred.

Similarly a variety of acids may be employed in the electroplating baths of the invention. In addition to sulfuric acid, suitable acids include acetic acid, fluoroboric acid, methane sulfonic acid and sulfamic acid.

The present invention also comprises alkaline electroplating baths. A suitable alkaline electrolytic plating solution in accordance with the invention has the inorganic chemical composition set forth in Table 2 below.

TABLE 2

| Component | Amount |
|---|---|
| copper pyrophophosphate trihydrate | 25 to 100 gm/liter |
| potassium pyrophosphate | 100 to 300 gm/liter |
| potassium hydroxide | 10 to 30 mg/liter |
| water | to 1 liter |

In addition to potassium hydroxide, a number of other bases can be employed in the alkaline baths of the invention. For example, suitable bases include sodium hydroxide and sodium carbonate.

Suitable plating baths and use of the same are also described in Coombs, *Printed Circuits Handbook,* ch. 12, McGraw Hill (3rd ed., 1988), and the *Metal Finishing Guidebook and Directory,* Metals & Plastics Publs., Inc. of Hackensack, New Jersey, both incorporated herein by reference.

A variety of organic additives may be employed in the above described plating compositions, including brighteners, levelers, surfactants, exaltants, suppressors and others. In particular, the invention employs brighteners and levelers in certain critical concentrations to markedly enhance performance characteristics of the electroplating bath.

The preferred method for determining and maintaining concentrations of both brightening and leveling agents in an electroplating bath is the following described method, also disclosed in said pending application. Referring to the Drawing, FIG. 1 shows the schematic wiring diagram for a device particularly useful for performing this preferred method of brightening and leveling agent analysis. Three electrodes, working electrode 1, counter electrode 2, and reference electrode 3, are immersed in bath cell 4. The counter electrode is selected and designed so as not to be easily polarized in the particular bath being evaluated. This is accomplished in part, by placing the counter electrode close to the working electrode. The working electrode is a suitable metal disk such as platinum, copper, nickel, chromium, tin, gold, silver, lead, solder, glassy carbon, mercury and stainless steel. The working electrode typically has a flat, polished surface, small diameter and may be mounted flush with the end of a Kel-F cylinder. A small diameter disk is preferred since a larger diameter will result in poor sensitivity due to non-uniform current density across the diameter. Other suitable working electrodes include any that provide a uniform current density and controlled agitation. The reference electrode is conventionally a saturated Calomel reference electrode. To establish relative motion between the working electrode and the bath, motor 5 is used to rotate the working electrode to which contact is made by slip brushes.

Computer 6 is used to control an electronic potentiostat 7 which controls the energy input between the working electrode relative to the reference electrode. Suitable instrumentation includes a Pine Instruments potentiostat under personal computer control. Using a suitable program, the energy input sequences of the present invention may be applied to the working electrode. The output of the device can also be plotted on an X-Y recorder to graphically display the changes in energy output versus time for each step. The terms "energy input" and "energy output" as used herein refer to control of the potential (energy input) while monitoring current density (energy output), or control of current density (energy input) while monitoring potential (energy output).

The analysis method begins with a cleaning step to clean the working electrode. An anodic cleaning process may be carried out galvanostatically at approximately 80 amps per square foot (ASF) for a time sufficient to clean the electrode or until the voltage reaches 1.6 volts. Alternatively, the cleaning may be carried out at 1.6 volts for approximately 10 seconds, or the electrode may be cleaned chemically by treating with nitric acid followed by rinsing with deionized water.

The second step is to plate a thin layer of copper, approximately 5–500 microinches, on the disk by placing the disk in an electroplating bath solution for 10–300 seconds at a plating current between 1–100 ASF. The solution is a standard solution containing only the inorganic plating chemicals, for example the compositions detailed above in Tables 1 and 2. The use of this thin film of copper eliminates problems associated with nucleation of metal on the disk during analysis. If the disk is made of a metal which readily adsorbs organic additives, or induces potential driven adsorption of the additives used in electroplating baths, this step is not needed.

In the next step, the bath sample is substituted for the standard solution containing only the inorganic chemicals with controlled agitation.

Figure 2:
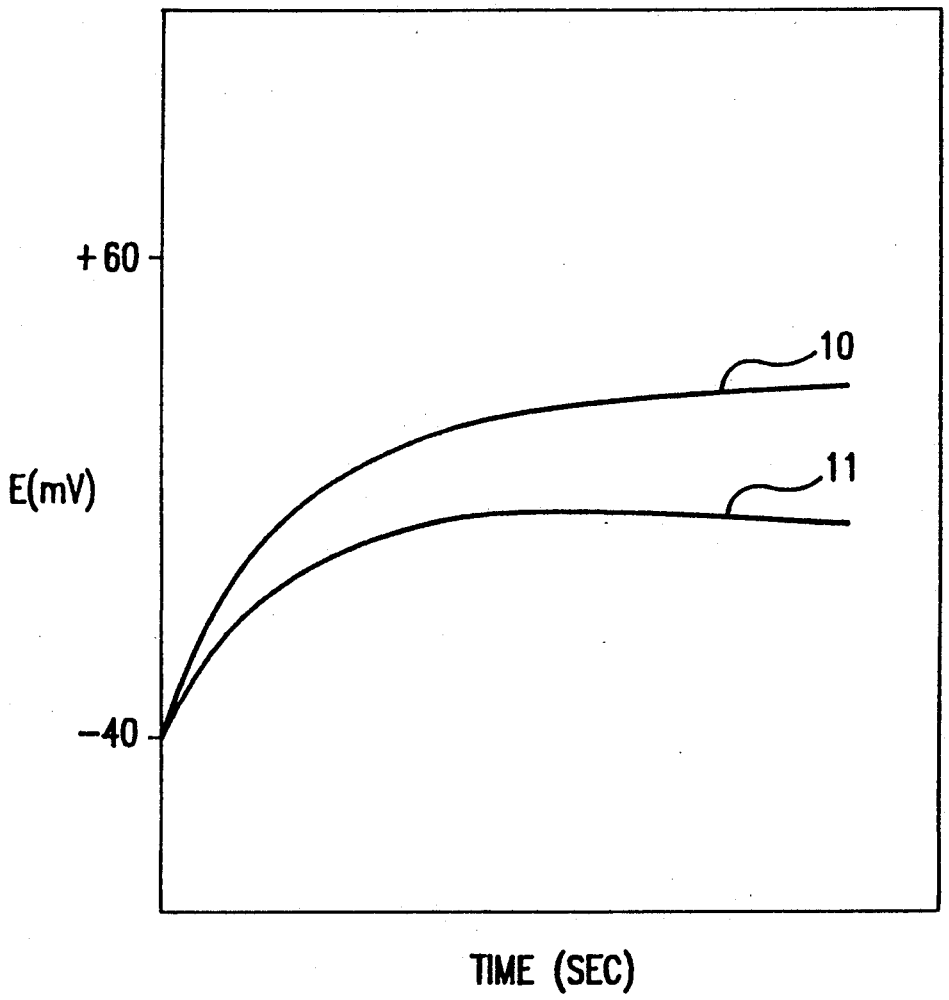
FIG. 2 is a potential-time diagram representing the equilibrating step of a preferred method for determining concentrations of organic additives of an aqueous solution.

During the equilibration step, no current is applied to the electrodes and the disk electrode is allowed to adsorb brightener for a period of time normally ranging between 5 seconds to 20 minutes, or until the equilibration potential becomes stable (i.e. change in potential with time is minimal). FIG. 2 shows the change in potential versus time for both a high brightener level 10 and a low brightener level 11. It is important that the brightener concentration remain unchanged during analysis, by having sufficient volume present, and that temperature and agitation are controlled throughout the equilibration process. For example, when using a 0.156 inch diameter disk, a minimum of 100 ml sample would be a sufficient volume. At the end of this equilibration step, the level of brightener may be correlated to the rate of adsorption (i.e., the slope of the potential-time plot) or, alternatively, to the final value of the potential.

Figure 3:
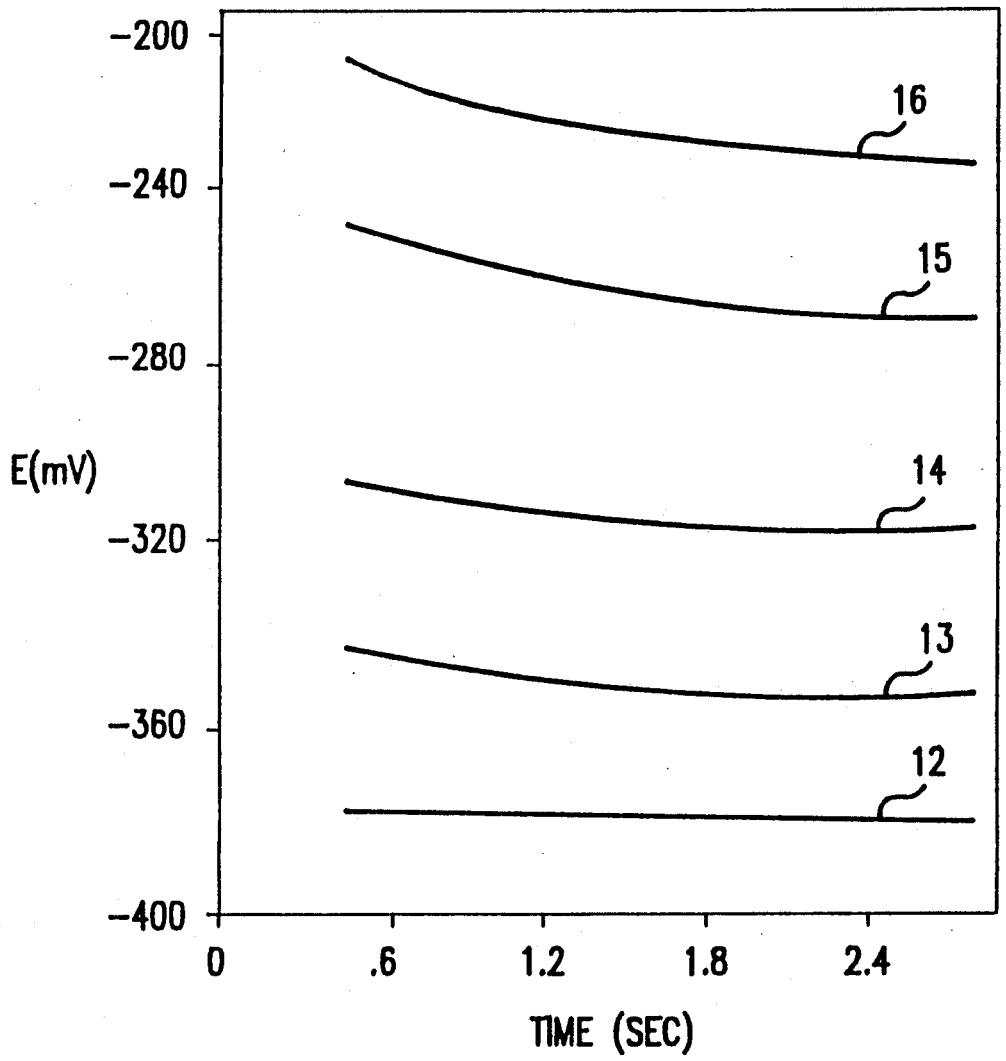
FIG. 3 is a potential-time plot of the initial plating potential for the metal plating step of said preferred method.

In the next step, copper plating is initiated by plating at a current density from 1 to 100 ASF for 0.001 seconds to 60 seconds. During this time, copper ions are deposited on the electrode. These ions may be combined with or bound to leveler, brightener, chloride ions, water and/or wetting agents present in the bath. The initial potential reading, upon initiation of plating, is directly related to the brightener concentration. FIG. 3 shows the differences in the initial plating potential during a time period of 0.001 to 3 seconds, for standards containing varying concentrations of brightener. Lines 12–16 correspond to concentrations of 0, 5, 10, 20 and 30 ppb of brightener, respectively. The following Table 3 correlates the initial potential to the concentration of brightener:

TABLE 3

| Concentration (ppb) | Potential (mV) |
|---|---|
| 0 | −378 |
| 5 | −345 |
| 10 | −310 |
| 20 | −260 |
| 30 | −220 |

As seen from the above data, sensitivity of the method allows for determinations of brightener concentration down to as little as 1 ppb.

Although the slope of the potential-time plot to be determined in the following last plating step of the leveler analysis is a function of the ratio of brightener to leveler, the slopes may vary depending on the absolute concentration of brightener. Once the quantity of brightener is determined from the previous steps. It may be necessary to add additional brightener to a fresh sample so that the amount of brightener more closely approximates the actual value of brightener in the standards, and then repeat the analysis sequence. Once this is done, the ratio of brightener to leveler will more accurately reflect the absolute amount of leveler.

As further discussed below, in addition to calculating the amount of leveler present in an electroplating solution, the energy-time plot determined in the final plating step of the leveler analysis can be used to determine the Leveler Potency Constant. The term "Leveler Potency Constant" refers to the leveling activity of a particular leveling agent relative to the leveling activity of 1-(2-hydroxyethyl)-2-imidazolidinethione. For an electroplating solution containing a leveling agent, the potential versus time plot of such an electroplating solution as determined in the final plating step of the leveler analysis is referred to herein as "change in energy per unit time due to the leveling agent", "change in energy per unit time of due to HIT", "slope of potential over time due to the leveling agent", "slope of potential over time due to HIT", or other similar phrase.

Figure 4:
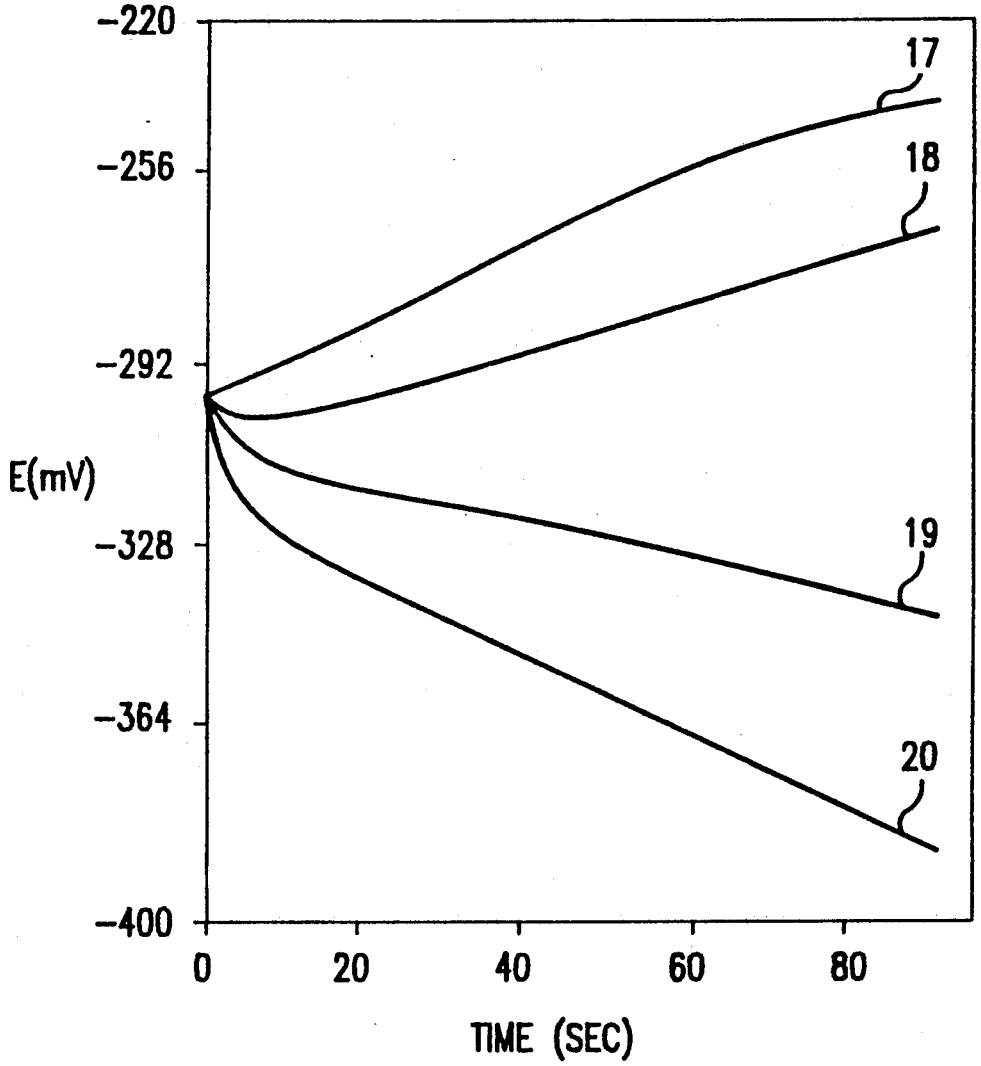
FIG. 4 is a potential-time diagram for the metal plating step for said preferred method.

In this next step of the analysis method, the final plating step of the leveler analysis, changes in potential are correlated to the ratio of brightener to leveler over time as the plating process continues. This step of continued plating may be at 1 to 200 ASF for a period of time ranging between 5 seconds to 10 minutes, more typically for 20 to 100 seconds. FIG. 4 shows a typical plot of changes in voltage over time for various standard concentrations of leveler when the brightener is held constant at 90 ppb. The slope of these lines can be correlated to the ratio of brightener to leveler in the bath and, as noted above, is used to determine quantity of leveler present in the bath as well as the leveling activity of the specific leveling agent. Lines 17–20 correspond to known leveler concentrations in four different standard solutions, namely leveler concentrations of 0, 50, 100, and 150 ppb, respectively.

Typically, to determine an unknown concentration of the same leveler as present in a standard solution(s), the slope of the voltage versus time plots would be generated for a plating solution containing the same brightener and concentration thereof as present in the standard solution(s), and an unknown concentration of the same leveler as present in the standard solution(s). The slope of the potential versus time plots for the solution containing an unknown leveler concentration then can be matched to corresponding plots obtained from the standard solution(s) to determine the unknown leveler concentration.

An apparatus employing the above described method and useful for analyzing concentrations of brightener and leveling agents of an electroplating solution is commercially available from the Shipley Co. of Newton, Massachusetts under the trade name of the Shipley Electroposit® Bath Analyzer.

In the electroplating solutions of the invention, suitable brighteners include those that comprise a group of the formula S-R-$SO_3$, where R is a substituted or unsubstituted alkyl or substituted or unsubstituted aryl group. More specifically, suitable brighteners include those of the structural formulas $X_3S$—R—SH, $XO_3$-S—R—S—S—R—$SO_3X$ and $XO_3$-S—Ar—S—S—Ar—$SO_3X$ where R is a substituted or unsubstituted alkyl group, and preferably is an alkyl group having from 1 to 6 carbon atoms, more preferably is an alkyl group having from 1 to 4 carbon atoms; Ar is an aryl group such as phenyl or naphthyl; and X is a suitable counter ion such as sodium or potassium. Specific suitable brighteners include n,n-dimethyl-dithiocarbamic acid-(3-sulfopropyl)ester, carbonic acid-dithio-o-ethylester-s-ester with 3-mercapto-1-propane sulfonic acid (potassium salt), bissulfopropyl disulfide, 3-(benzthiazolyl-s-thio)propyl sulfonic acid (sodium salt), pyridinium propyl sulfonic sulfobetaine. Suitable brighteners are also described in U.S. Pat. Nos. 3,770,598, 4,374,709, 4,376,685, 4,555,315, and 4,673,469, all incorporated herein by reference.

It has been further found that plating of enhanced quality is realized where one or more brightener agents are employed in a electroplating solution within a concentration range of from about 1 ppb to 1 ppm.

While not wishing to be bound by theory, it is believed that most, if not all, commercially available brightener agents break down in solution to an active species having a like structure of the formula HS-R-$SO_3$, where R is of the same structure as the corresponding moiety of the parent brightening agent, i.e., R is a substituted or unsubstituted alkyl or aryl group. This species HS-R-$SO_3$ is believed to be the active form of a brightener that participates in electrolytic plating deposition at the substrate surface. Such "break down" of a parent brightening agent to an active species of the above formula is believed to result from a reaction that occurs in the plating solution.

It is further believed that once present in a plating bath, the active species will react at a distance from the cathode to form a dimer. More specifically, once present in a plating bath, an active brightener of the formula HS-R-$SO_3$ will react to form a dimer of the formula $O_3S$—R—S—S—R—$SO_3$. It is believed that the formation of the brightener active species and corresponding dimer is dynamic; and that during operation of the plating bath an equilibrium is established between the brightener active species concentration and the concentration of the corresponding dimer. It is also believed that a number of factors can affect this concentration equilibrium, such as anode and cathode current density, the dissolved oxygen content of the plating solution, the presence of contaminants in the plating solution, and the number of substrates plated in the plating solution per unit time.

The dimer product of the active species of the brightener is also believed to act as a buffer, enabling the deposit of highly uniform metal plates with use of quite low concentrations (including concentrations of 30 ppb or less) of the active brightener species at relatively high concentrations of the dimer buffer.

In accord with the foregoing, it has been found that copper plates of enhanced quality are provided if a brightening agent is employed in a plating solution where the brightening agent has a structure corresponding to either of the following formulas (I) or (II):

$$HS—R—SO_3 \quad (I)$$

$$O_3S—R—S—S—R^1—SO_3 \quad (II)$$

where R and $R^1$ are independently selected from the group of a substituted or unsubstituted aryl group, or a substituted or unsubstituted alkyl group. Typically the alkyl groups have from 1 to 6 carbon atoms, more typically from 1 to 4 carbon atoms. Suitable aryl groups include substituted or unsubstituted phenyl or napthyl. The substituents of the alkyl and aryl groups may be, for example, alkyl, halo and alkoxy. It is understood that these preferred brightening agents are typically stored as the corresponding sulfono salt, i.e., salts of the formulas $HS—R—SO_3X$ and $XO_3S—R—S—S—R^1—SO_3X$, where X is a suitable counter ion such as potassium or sodium. Exemplary of such preferred brightening agents are 3-mercapto-propylsulfonic acid (sodium salt), 2-mercapto-ethanesulfonic acid (sodium salt), and bissulfopropyl disulfide.

By employing such brightening agents of formulas (I) or (II), the plating bath should not require extended cycling periods to generate the equilibrium concentrations of active brightener species and dimer buffer. For less preferred brighteners of a structure other than the above formulas (I) and (II), extended cycling periods may be required to generate the active species that participates in plating at the cathode. Further, the "break down" reaction occurring in the plating solution of such less preferred brighteners potentially can yield undesirable products that will compromise plating uniformity.

It has further been found that metal deposits of enhanced quality are provided by operating an electrolytic plating bath with one or more brightening agents of formula (I), as defined above, in an amount (based on total bath weight) of from about 1 ppb to 1 ppm, more preferably in an amount of from about 1 ppb to 250 ppb, still more preferably in an amount of from about 1 ppb to 100 ppb. It has also been found that metal deposits of enhanced quality are provided by operating an electrolytic plating bath with one or more brightening agents of formula (II), as defined above, in an amount (based on total bath weight) of from about 1 ppb to 1 ppm, more preferably in an amount of from about 1 ppb to 500 ppb, still more preferably in an amount of from about 10 ppb to 200 ppb. An electroplating solution also will be operated with a mixture of brightening agents consisting of one or more compounds of each of formulas (I) and (II). An electrolytic plating solution containing a mixture of brightening agents of formulas (I) and (II) is preferably operated where the concentration of said brightening agent mixture in the solution (based on total bath weight) is from about 1 ppb to 1 ppm, more preferably in an amount of from about 1 ppb to 500 ppb, still more preferably in an amount of from about 10 ppb to 300 ppb.

A variety of levelers may be employed in the electroplating solutions of the invention. Suitable levelers include those containing a functional group of the formula N—R—S, where R is a substituted or unsubstituted alkyl group or a substituted or unsubstituted aryl group. Typically the alkyl groups have from 1 to 6 carbon atoms, more typically from 1 to 4 carbon atoms. Suitable aryl groups include substituted or unsubstituted phenyl or napthyl. The substituents of the alkyl and aryl groups may be, for example, alkyl, halo and alkoxy. Specifically suitable levelers include 1-(2-hydroxyethyl)-2-imidazolidinethione, 4-mercaptopyridine, 2-mercaptothiazoline, ethylene thiourea, thiourea and alkylated polyalkyleneimine. The most preferred leveler is 1-(2-hydroxyethyl)-2-imidazolidinethione (said most preferred leveler sometimes referred to herein as "HIT"). Other suitable leveling agents are described in the above incorporated U.S. Pat. Nos. 3,770,598, 4,374,709, 4,376,685, 4,555,315 and 4,673,459.

It has been found that metal deposits of enhanced quality are provided by employing certain critical leveling agent concentrations in an electrolytic plating bath. In general, enhanced plating is realized where the concentration in a plating bath of the most preferred leveler, 1-(2-hydroxyethyl)-2-imidazolidinethione, is less than about 1 ppm based on total plating bath weight. More preferably, the concentration (based on total bath weight) of 1-(2-hydroxyethyl)-2-imidazolidinethione in a plating bath is less than about 500 ppb, and still more preferably the concentration of HIT in a plating bath is less than about 200 ppb (based on total bath weight).

It has been further found that 1-(2-hydroxyethyl)-2-imidazolidinethione is preferably used within the above concentration ranges, but at a specific level that varies with concentration of the brightening agent in the plating bath, and with the specific plating conditions such as plating speed and difficulty of the circuit board being plated. In particular, it has been found that enhanced plating quality is realized where the HIT concentration increases (within the above preferred ranges) with increase in circuit board difficulty.

In addition to maintaining the brightener and leveler agents within the above preferred concentration ranges, it has also been found to be crucial to control the weight:weight (w/w) ratio of leveling and brightening agents. Enhanced leveling, throwing power and surface distribution can be obtained when the w/w ratio of the preferred leveling agent (i.e., HIT) to preferred brightener agents (i.e., brighteners of formula I and/or II above) in the plating bath is less than about 20:1. More preferably, the w/w ratio of the preferred leveling agent to brightening agent in the plating bath is less than about 5:1. At relatively high current densities of about 30 to 35 ASF or greater the leveler-brightener w/w ratio is preferably maintained at less than about 0.5:1. It has been found that at such high current densities a more restricted weight ratio is required to yield a metal plate with good ductility and other mechanical properties.

Preferred concentrations and leveler-brightener w/w ratios for leveling agents other than HIT can be readily ascertained based on activity of the particular leveler in a plating process. That is, the preferred concentration of a leveler is directly proportional to its leveling activity in a plating bath. As is known in the art, a variety of factors can effect leveling properties such as a leveler's steric bulk.

More specifically, preferred concentrations and w/w ratios for leveling agents other than HIT can be determined by calculation of the Leveler Potency Constant (sometimes referred to herein as the "LPC").

As used herein, the terms "change in energy per unit time due to the leveling agent", "change in energy per unit time due to HIT", "slope of potential over time due to the leveling agent", "slope of potential over time due to HIT", or other similar expression refers to the potential versus time plot of the last plating step of the leveler analysis, as discussed above.

The LPC of a particular leveling agent is defined to mean herein the ratio of the function of the change of energy per unit time at a given concentration of the particular leveling agent to the function of the change of energy per unit time of HIT, where the concentration of HIT is the same as that of the particular leveling agent. That is, $$LPC = \frac{f(\text{change in energy per unit time due to the leveling agent})}{f(\text{change in energy per unit time due to } HIT)}$$

It has been found that for at least most leveling agents, the plots of change in energy per unit time of the leveling agent provides slopes that are substantially straight lines. In particular, the plot of HIT provides a slope that is straight line. Hence, for at least most leveling agents, a fair approximation of the LPC for a particular leveling agent is the ratio of the slope potential over time due to the particular leveling agent to the slope of potential over time due to HIT, where the concentration of the particular leveling agent and HIT are the same, i.e., $$LPC = \frac{\text{slope of potential over time due to the leveling agent}}{\text{slope of potential over time due to } HIT}$$

It should be appreciated that the Leveler Potency Constant can vary with the concentration of the leveler species. Further, the above equation for the LPC will be valid over the entire range of HIT concentrations if said slope of potential over time due to a zero concentration (ppb) of HIT is defined at zero; and therefore, said slope of potential over time due to all other leveling agents, including HIT, are referenced to a slope of potential over time due to a zero concentration (ppb) of HIT.

To determine preferred plating bath concentrations of a particular leveling agent, a preferred concentration of HIT, as set forth above, is divided by the LPC for the particular leveling agent.

In similar fashion, to determine preferred leveler-brightener w/w ratios for a particular leveler, a leveler-brightener preferred w/w ratio, as set forth above, is divided by the LPC for the particular leveler.

In addition to brightening and leveling agents as discussed above, another particularly preferred additive to an electroplating solution of the invention is wetting agents such as polyethylene oxides (mol. wt. 300,000 to 4 million), polyoxyalkylene glycols, block copolymers of polyoxyalkylenes, polyalkylene glycols, alkylpolyether sulfonates; complexing surfactants such as alkoxylated diamines, ethoxylated amines, polyoxyalkylene amines; and complexing agents for cupric or cuprous ions which include entprol, citric acid, acetic acid, tartaric acid, potassium sodium tartrate, acetonitrile, cupreine and pyridine. A particularly preferred wetting agent is the polyethylene oxides sold under the trade name of Polyox N750 by Union Carbide. A wetting agent is suitably used in a plating solution in a concentration of from about 100 to 10,000 ppm based on the total weight of the plating solution.

The plating solutions of the invention are generally used in conventional manner. They are preferably used at room temperature, but may be used at elevated temperatures up to and somewhat above 65° C. In use, the plating solution is preferably used with solution agitation. This may be accomplished in a variety of ways including an air sparger, work piece agitation or by impingement. Plating is preferably conducted at a current ranging between 1 and 40 ASF depending upon substrate characteristics, for example circuit board difficulty. Plating time is normally 27 minutes for a 1 mil thick circuit board plated at 40 ASF.

The following non-limiting examples are presented to further illustrate the invention. In each of the examples, the described printed circuit boards had been electrolessly plated by conventional techniques such as disclosed in U.S. Pat. No. 3,765,936, incorporated herein by reference, to provide a copper plate of 0.06–0.08 mm thickness over the length of the boards, through hole walls. Also, in each of the examples, concentrations of brightener and leveling agents were determined using a Shipley Co. Electroposit® Bath Analyzer employing the analysis method disclosed above and in said pending application.

EXAMPLE 1

A 350 gallon air agitated plating tank outfitted with four cathode rails and one rectifier was charged with the following composition: 80 g/l $CuSO_4.5H_2O$, 225 g/l $H_2SO_4$, 50 ppm chloride ions (based on total bath weight), 1 g/l of a wetting agent of polyethylene oxides (mol. weight 10,000 to 4 million and sold under the trade name of Polyox N750 by Union Carbide), 0.6 ppm of a leveler of 1-(2-hydroxyethyl)-2-imidazolidinethione, balance water. This plating bath was electrolyzed using a dummy cathode for the following current densities and times: 10 ASF for 1 hour, 15 ASF for 1 hour, and 20 ASF for 2 hours. A brightener of 3-mercaptopropylsulfonic acid (sodium salt) was then added to this plating bath. A printed circuit board having a thickness of 0.100 inches, through holes of a diameter of 0.045 inches, and between 0.002 and 0.0027 inches of etch back along said through holes was plated in the above described tank and plating solution and where analysis showed a concentration of the 3-mercapto-propylsulfonic acid to be in the range of 60 to 90 ppb based on total bath weight, and the concentration of 1-(2-hydroxyethyl)imidazolidinethione to be about 60 ppb based on total bath weight. During plating, current density was 19 ASF, and the plating solution was operated at a temperature of about 25° C. and was air agitated. At the termination of the plating procedure, a through hole of the board was examined. It was found that copper generally did not fill in or level the etched back regions of the through hole.

EXAMPLE 2

A printed circuit board having a thickness of 0.100 inches, through holes of a diameter of 0.045 inches, and 0.002 inches of etch back along said through holes was immersed in a 350 gallon air agitated tank outfitted with four cathode rails and one rectifier charged with a plating bath of the same composition as described in Example 1 above, except the concentration of 1-(2-hydroxyethyl)-2-imidazolidinethione was about 120 ppb (based on total bath weight) during plating. Plating was conducted under the same conditions as described in Example 1 above, except the relatively high plating speed of 38 ASF was used. After termination of the plating procedure, a through hole of the board was examined. It was found that copper completely filled in the noted etched back through hole regions to provide a smooth uniform copper plate along the through hole walls.

EXAMPLE 3

A printed circuit board having a thickness of 0.16 inches, and through holes of a diameter of 0.0385 inches was immersed in a plating bath of the following composition that had been previously cycled for about 3 hours: 80 g/l copper sulfate pentahydrate, 225 g/l sulfuric acid, 50 ppm chloride ions (based on total bath weight), 1 g/l of a wetting agent of polyethylene oxides (mol. weight 10,000 to 4 million and sold under the trade name of Polyox N750 by Union Carbide), balance water. The circuit board was plated at 10 ASF with the described bath held at 25° C. and agitated. After termination of the plating procedure, examination of the copper plate on the board's through hole walls showed the plating bath provided throwing power of about 50 percent.

EXAMPLE 4

A printed circuit board having a thickness of 0.16 inches, and through holes of a diameter of 0.0385 inches was immersed in a plating bath of the same composition as described in Example 3 except 3-mercapto-propylsulfonic was added to the bath in an amount sufficient to provide a concentration during plating of about 15 ppb based on total bath weight, and 1-(2-hydroxyethyl)-2-imidazolidinethione was added to the bath in an amount sufficient to provide a concentration during plating of about 60 ppb based on total bath weight. The immersed circuit board was plated under the same general conditions of Example 3, namely at a current density of 10 ASF with the plating bath held at 25° C. and solution agitation. After termination of the plating procedure, examination of the copper plate on the board's through hole walls showed the plating bath provided throwing power of about 73 percent.

EXAMPLE 5

A printed circuit board having a thickness of 0.16 inches, and through holes of a diameter of 0.0385 inches was immersed in a plating bath of the same composition as described in Example 3 except 3-mercapto-propylsulfonic was added to the bath in an amount sufficient to provide a concentration during plating of about 15 ppb based on total bath weight, and 1-(2-hydroxyethyl)-2-imidazolidinethione was added to the bath in an amount sufficient to provide a concentration during plating of about 120 ppb based on total bath weight. The immersed circuit board was plated under the same general conditions of Example 3, namely at a current density of 10 ASF with the plating bath held at 25° C. and solution agitation. After termination of the plating procedure, examination of the copper plate on the board's through hole walls showed the plating bath provided throwing power of about 98 percent.

The foregoing description of the invention is merely illustrative thereof, and it is understood that variations and modifications can be effected without departing from the scope or spirit of the invention as set forth in the following claims.

What is claimed is:

1. An aqueous electroplating solution, comprising:

at least one soluble copper salt, an electrolyte, and one or more brightening agents of the formula $HS—R—SO_3$ wherein R is substituted or unsubstituted aryl or substituted or unsubstituted alkyl, and wherein the concentration of said brightening agents of formula $HS—R—SO_3$ is from about 1 ppb to 250 ppb based on total weight of the electroplating solution.

2. The electroplating solution of claim 1 where the concentration of the brightening agent of the formula $HS—R—SO_3$ in the electroplating solution is from about 1 ppb to 100 ppb based on total weight of the electroplating solution.

3. The electroplating solution of claim 1 wherein R is selected from the group consisting of substituted or unsubstituted phenyl and substituted or unsubstituted alkyl having from 1 to 6 carbon atoms.

4. The electroplating solution of claim 1 where the one or more brightening agents comprise a brightening agent of the formula $O_3S—R—S—S—R^1—SO_3$ wherein R and $R^1$ are each independently selected from the group consisting of substituted or unsubstituted aryl and substituted or unsubstituted alkyl.

5. The electroplating solution of claim 4 where the concentration of the brightening agent of the formula $O_3S—R—S—S—R^1—SO_3$ in the electroplating solution is from about 10 ppb to 200 ppb based on total weight of the electroplating solution.

6. The electroplating solution of claim 4 wherein R and $R^1$ are each independently selected from the group consisting of substituted or unsubstituted phenyl and substituted or unsubstituted alkyl having from 1 to 6 carbon atoms.

7. The electroplating solution of claim 1 where the one or more brightening agents are selected from the group consisting of mercapto-propylsulfonic acid, mercapto-ethanesulfonic acid and bissulfopropyl disulfide.

8. The electroplating solution of claim 1 where the one or more brightening agents is a mixture of brightening agents, said mixture consisting essentially of one or more brightening agents of the formula $HS—R—SO_3$ wherein R is selected from the group consisting of substituted or unsubstituted aryl and substituted or unsubstituted alkyl, and one or more brightening agents of the formula $O_3S—R—S—S—R^1—SO_3$ wherein R and $R^1$ are each independently selected from the group consisting of substituted or unsubstituted aryl and substituted or unsubstituted alkyl, the concentration of said mixture in the electroplating solution being from about 1 ppb to 500 ppb based on total weight of the electroplating solution.

9. The electroplating solution of claim 1 further comprising one or more wetting agents.

10. The electroplating solution of claim 1 where the electrolyte is an acid used in combination with halide ions.

11. The electroplating solution of claim 1 where the electrolyte comprises a base.

12. The electroplating solution of claim 1 further comprising a leveling agent.

13. The electroplating solution of claim 12 where the leveling agent contains a group of the formula N—R—S, where R is selected from the group consisting of substituted or unsubstituted aryl and substituted or unsubstituted alkyl.

14. The electroplating solution of claim 12 where the leveling agent is present in the electroplating solution in a concentration, based on total weight of the electroplating solution, in a range equal to 1 ppm or less divided by the Leveler Potency Constant of the leveling agent.

15. The electroplating solution of 12 further comprising one or more wetting agents.

16. The electroplating solution of claim 12 where the leveling agent-brightener w/w ratio is less than about 20:1 divided by the Leveler Potency Constant of the leveling agent.

17. The electroplating solution of claim 12 where the leveling agent-brightener w/w ratio is less than about 5:1 divided by the Leveler Potency Constant of the leveling agent.

18. The electroplating solution of claim 12 where the leveling agent is 1-(2-hydroxyethyl)-2-imidazolidinethione.

19. The electroplating solution of claim 18 where the leveling agent is present in the electroplating solution in a concentration of less than about 1 ppm based on total weight of the electroplating solution.

20. The electroplating solution of claim 18 where the leveling agent is present in the electroplating solution in a concentration of less than about 500 ppb based on total weight of the electroplating solution.

21. The electroplating solution of claim 18 where the leveling agent is present in the electroplating solution in a concentration of less than about 200 ppb based on total weight of the electroplating solution.

22. The electroplating solution of claim 18 where the leveling agent-brightener w/w ratio is less than about 20:1.

23. The electroplating solution of claim 18 where the leveling agent-brightener w/w ratio is less than about 5:1.

24. A process for electrodepositing copper on a substrate, comprising:

electrolytically depositing copper on the substrate from an aqueous electroplating solution, the solution comprising at least one soluble copper salt, an electrolyte, and one or more brightening agents of the formula HS—R—$SO_3$ wherein R is substituted or unsubstituted aryl or substituted or unsubstituted alkyl, and wherein the concentration of said brightening agents of formula HS—R—$SO_3$ is from about 1 ppb to 250 ppb based on total weight of the electroplating solution.

25. The process of claim 24 where the substrate has irregular topography.

26. The process of claim 24 where the concentration of the brightening agent of the formula HS—R—$SO_3$ in the electroplating solution is from about 1 ppb to 100 ppb based on total weight of the electroplating solution.

27. The process of claim 24 where the substrate is a printed circuit board having through holes.

28. The process of claim 27 where the through holes have an aspect ratio equal to or greater than about ten to one.

29. The process of claim 27 where the one or more brightening agents is a mixture of brightening agents, said mixture consisting essentially of (1) one or more brightening agents of the formula HS—R—$SO_3$ wherein R is selected from the group consisting of substituted or unsubstituted aryl and substituted or unsubstituted alkyl, and (2) one or more brightening agents of the formula $O_3S$—R—S—S—$R^1$—$SO_3$ wherein R and $R^1$ are each independently selected from the group consisting of substituted or unsubstituted aryl and substituted or unsubstituted alkyl, the concentration of said mixture in the electroplating solution being from about 1 ppb to 500 ppb.

30. The process of claim 27 where the one or more brightening agents comprise a brightening agent of the formula $O_3S$—R—S—S—$R^1$—$SO_3$ wherein R and $R^1$ are each independently selected from the group consisting of substituted or unsubstituted aryl and substituted or unsubstituted alkyl.

31. The process of claim 30 where the concentration of the brightening agent of the formula $O_3$-S—R—S—S—$R^1$—$SO_3$ in the electroplating solution is from about 1 ppb to 500 ppb based on total weight of the electroplating solution.

32. The process of claim 30 where the concentration of the brightening agent of the formula $O_3$-S—R—S—S—$R^1$—$SO_3$ in the electroplating solution is from about 10 ppb to 200 ppb based on total weight of the electroplating solution.

33. The process of claim 27 further comprising a leveling agent.

34. The process of claim 33 where the leveling agent-brightener w/w ratio is less than about 20:1 divided by the Leveler Potency Constant of the leveling agent.

35. The process of claim 33 where the leveling agent-brightener w/w ratio is less than about 5:1 divided by the Leveler Potency Constant of the leveling agent.

36. The process of claim 33 where copper is deposited at a current density of about 30 ASF or greater and the leveling agent-brightener w/w ratio is less than about 0.5:1.

37. The process of claim 33 where the leveling agent is present in the electroplating solution in a concentration, based on total weight of the electroplating solution, in a range equal to 1 ppm or less divided by the Leveler Potency Constant of the leveling agent.

38. The process of claim 36 where the leveling agent is present in the electroplating solution in a concentration of less than about 1 ppm, and the leveling agent-brightener w/w ratio is equal to a value of less than about 20 divided by the Leveler Potency Constant of the leveling agent.

39. The process of claim 33 where the electroplating solution further comprises one or more wetting agents.

40. The process of claim 33 where the leveling agent is 1-(2-hydroxyethyl)-2-imidazolidinethione and is present in the electroplating solution in a concentration of less than about 1 ppm based on total weight of the solution.

41. The process of claim 40 where the leveling agent is present in the electroplating solution in a concentration of less than about 500 ppb based on total weight of the solution.

42. The process of claim 40 where the leveling agent is present in the electroplating solution in a concentration of less than about 200 ppb based on total weight of the solution.

43. The process of claim 40 where the leveling agent-brightener w/w ratio is less than about 20:1.

44. The process of claim 40 where the leveling agent-brightener w/w ratio is less than about 5:1.

45. The process of claim 40 where copper is deposited at a current density of about 30 ASF or greater and the leveling agent-brightener w/w ratio is less than about 0.5:1.

46. An aqueous electroplating solution, comprising:

at least one soluble copper salt, an electrolyte, and one or more brightening agents, at least of one of said one or more brightening agents having the structural formula HS—R—$SO_3$ wherein R is selected from the group consisting of substituted or unsubstituted aryl and substituted or unsubstituted alkyl, and wherein the concentration of said brightening agent of the structural formula HS—R—$SO_3$ in the electroplating solution is from about 1 ppb to 250 ppb.

* * * * *